US010088139B2

(12) United States Patent
Liang

(10) Patent No.: US 10,088,139 B2
(45) Date of Patent: Oct. 2, 2018

(54) INTEGRATED MICRO-LIGHT-EMITTING-DIODE MODULE WITH BUILT-IN PROGRAMMABILITY

(71) Applicant: PHILIPS LIGHTING HOLDING B.V., Eindhoven (NL)

(72) Inventor: Jia Liang, Rosemont, IL (US)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 302 days.

(21) Appl. No.: 14/889,519

(22) PCT Filed: May 5, 2014

(86) PCT No.: PCT/IB2014/061192
§ 371 (c)(1),
(2) Date: Nov. 6, 2015

(87) PCT Pub. No.: WO2014/184699
PCT Pub. Date: Nov. 20, 2014

(65) Prior Publication Data

US 2016/0076751 A1 Mar. 17, 2016

Related U.S. Application Data

(60) Provisional application No. 61/822,470, filed on May 13, 2013.

(51) Int. Cl.
*F21V 23/06* (2006.01)
*H05B 33/08* (2006.01)
(Continued)

(52) U.S. Cl.
CPC ..... *F21V 23/06* (2013.01); *F21K 9/20* (2016.08); *F21S 2/005* (2013.01); *F21V 23/005* (2013.01);
(Continued)

(58) Field of Classification Search
CPC ... A63H 33/08; F21K 9/20; F21K 9/00; F21S 2/005; F21V 21/005; F21V 21/30;
(Continued)

(56) References Cited

U.S. PATENT DOCUMENTS 4,792,319 A 12/1988 Svagerko
6,851,831 B2 * 2/2005 Karlicek, Jr. ..... H01R 29/00 362/227
(Continued)

FOREIGN PATENT DOCUMENTS

CN 201797619 U 4/2011
CN 202196976 U 4/2012
(Continued)

*Primary Examiner* — Hargobind S Sawhney
(74) *Attorney, Agent, or Firm* — Akarsh P. Belagodu

(57) ABSTRACT

A lighting system includes a plurality of micro-module cells that each have independent functionality. The micro-module cells include a first micro-module cell configured to supply power for the lighting system, and a second micro-module cell including a solid-state lighting source configured to emit light responsive to the supplied power from the first micro-module cell. A first connector cell is configured to detachably connect the second micro-module cell to the first micro-module cell, and provide electrical connection between the first and second micro-module cells.

22 Claims, 12 Drawing Sheets

(51) Int. Cl.

| | |
|---|---|
| ***F21V 23/00*** | (2015.01) |
| ***F21V 23/02*** | (2006.01) |
| ***F21S 2/00*** | (2016.01) |
| ***F21K 9/20*** | (2016.01) |
| *F21Y 115/10* | (2016.01) |

(52) U.S. Cl.
CPC ..... *F21V 23/02* (2013.01); *H05B 33/0815* (2013.01); *H05B 33/0821* (2013.01); *H05B 33/0845* (2013.01); *F21Y 2115/10* (2016.08)

(58) Field of Classification Search
CPC ..... F21V 23/005; F21V 23/06; F21V 23/023; F21Y 2115/10; H01L 2224/48247; H05B 3/16; H05B 33/0815; H05B 33/0845; H05B 37/0254; H05B 33/0803; H05K 1/142; H05K 2201/09027; H05K 2201/10106
See application file for complete search history.

(56) References Cited

U.S. PATENT DOCUMENTS

| | | | | |
|---|---|---|---|---|
| 7,080,927 | B2 * | 7/2006 | Feuerborn | F21S 2/005 362/238 |
| 7,824,073 | B2 * | 11/2010 | Hsieh | F21S 2/005 362/249.02 |
| 8,203,166 | B2 * | 6/2012 | Chin | F21S 2/005 257/730 |
| 9,163,797 | B2 * | 10/2015 | Sun | F21S 2/005 |
| 2005/0083691 | A1 * | 4/2005 | Jahn | F21S 2/005 362/382 |
| 2009/0237936 | A1 | 9/2009 | Ku | |
| 2010/0033956 | A1 * | 2/2010 | Kirchberger | G09F 13/14 362/97.1 |
| 2010/0118532 | A1 | 5/2010 | Liang et al. | |
| 2010/0123380 | A1 | 5/2010 | Lee | |
| 2011/0291588 | A1 | 12/2011 | Tagare | |
| 2012/0075871 | A1 | 3/2012 | Chen | |
| 2013/0020955 | A1 | 1/2013 | Igaki et al. | |
| 2013/0027905 | A1 * | 1/2013 | Lee | F21K 9/00 362/84 |

FOREIGN PATENT DOCUMENTS

| | | | |
|---|---|---|---|
| EP | 2175696 | A2 | 4/2010 |
| EP | 2261550 | A2 | 12/2010 |
| EP | 2363631 | A2 | 9/2011 |
| FR | 2438792 | A1 | 5/1980 |
| GB | 215459 | A | 12/1928 |
| WO | 2007069130 | A2 | 6/2007 |
| WO | 2013035016 | A1 | 3/2013 |

* cited by examiner

INTEGRATED MICRO-LIGHT-EMITTING-DIODE MODULE WITH BUILT-IN PROGRAMMABILITY

CROSS-REFERENCE TO PRIOR APPLICATIONS

This application is the U.S. National Phase application under 35 U.S.C. § 371 of International Application No. PCT/IB2014/061192, filed on May 5, 2014, which claims the benefit of U.S. Provisional Patent Application No. 61/822,470, filed on May 13, 2013. These applications are hereby incorporated by reference herein.

TECHNICAL FIELD

The present invention is directed generally to lighting systems employing solid state lighting devices. More particularly, various inventive apparatuses and methods disclosed herein relate to implementing and using integrated micro-module cells to provide extendable building block architecture for lighting applications.

BACKGROUND

Digital lighting technologies, i.e. illumination based on semiconductor solid-state light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects.

In view of the above advantages, LEDs have been increasingly used in the lighting industry to retrofit conventional lighting applications. However, LED lighting modules and systems, as typically implemented in these conventional lighting applications, often include fixed fixture design with LED panels, a specific electronic driver, wiring and other components for specific lumens, light patterns, etc. The advantages of LED lighting thus have not been fully realized. For example, by utilizing the point-like characteristics of LEDs, the necessary lumen output for desired light patterns may be reduced, while at the same time providing varied light distribution, color/color temperature, and brightness. In the meantime, with the development of integrated circuit technology, power-system-on-chip (PSoC) technology is rapidly developing.

Thus, it would be desirable to provide modular lighting systems architecture that fully utilize the advantages of LEDs as point sources in combination with integrated electronic drivers, while addressing shortcomings of known approaches.

SUMMARY

Applicants have recognized and appreciated that it would be beneficial to provide micro-module cells configured as self-operating building blocks for an LED-based lighting system that may be extendable for different light patterns having a variety of color, brightness/lumens, and light beam distribution. It would be further desirable to provide built-in programmability for such micro-module cells.

Generally, in one aspect, the invention relates to a lighting system including a plurality of micro-module cells that each have independent functionality, the micro-module cells comprising a first micro-module cell configured to supply power for the lighting system, and a second micro-module cell including a solid-state lighting source configured to emit light responsive to the supplied power from the first micro-module cell; and a first connector cell configured to detachably connect the second micro-module cell to the first micro-module cell, and provide electrical connection between the first and second micro-module cells.

In another aspect, the invention relates to a lighting system includes a power micro-module cell configured to supply power to the lighting system; a plurality of basic micro-module cells each comprising at least one light emitting diode (LED) for emitting light responsive to a driving current, and an integrated driver configured to output the driving current responsive to the supplied power; and a plurality of connector cells configured to detachably connect the basic micro-module cells to at least one of the power micro-module cell and other ones of the basic micro-module cells, and provide electrical connection between the power micro-module cell and the plurality of basic micro-module cells, wherein the power and basic micro-module cells each comprise a housing having a plurality of exterior sidewalls, one or more of the exterior sidewalls of the housing having a concave terminal, and the connector cells having protruding terminals configured to be insertable into the concave terminal for providing electrical connection.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources, including one or more LEDs as defined above. A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources such as one or more strings of LEDs as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices may be coupled to some network and each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

In the following detailed description, for purposes of explanation and not limitation, representative embodiments disclosing specific details are set forth in order to provide a thorough understanding of the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the present teachings.

Figure 1:
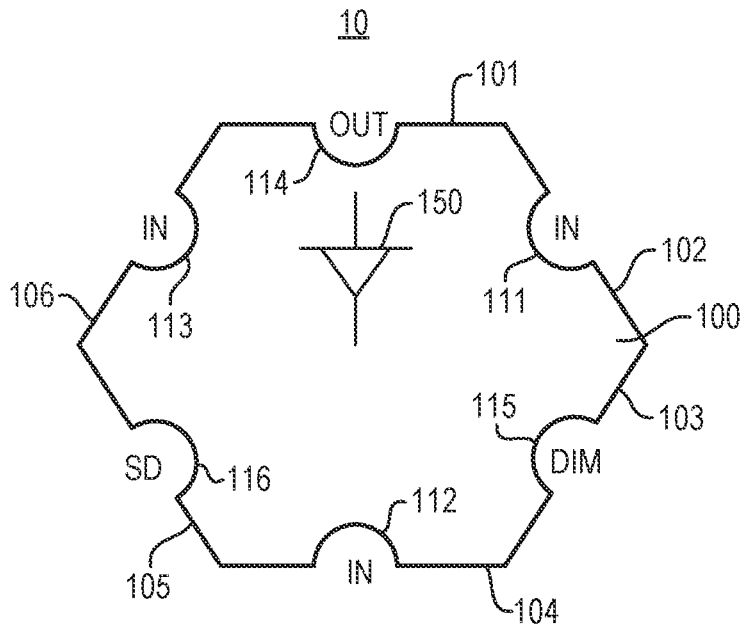
FIG. 1 shows a top plan view of a basic micro-module cell 10, according to a representative embodiment.

FIG. 1 shows a top plan view of a basic micro-module cell 10, according to a representative embodiment of the invention. Basic micro-module cell (second micro-module cell) 10 includes a housing 100 that is generally hexagonally shaped with a top surface, a bottom surface (not shown) and six exterior sidewalls 101, 102, 103, 104, 105 and 106. A solid-state lighting source 150, which may be at least one light emitting diode (LED) or a string of LEDs, is disposed to emit light from the top surface of housing 100. Sidewalls 101, 102, 103, 104, 105 and 106 are configured to respectively include an output (OUT) terminal 114, an input (IN) terminal 111, a dimming (DIM) terminal 115, an input (IN) terminal 112, a shut down (SD) terminal 116 and an input (IN) terminal 113. Each of terminals 111, 112, 113, 114, 115 and 116 are concave terminals formed within the sidewalls of housing 100, and are configured to have corresponding shape and dimension to insertably receive and hold a protruding terminal having corresponding conforming shape and dimension (such as protruding terminal 610 shown in FIGS. 11A and 11B). Basic micro-module cell 10 is further configured to include within housing 100 gate control logic such as a control circuit for example, and an integrated electronic driver such as a DC to DC buck converter for example, to supply power and control dimming of solid-state lighting source 150, as will be subsequently described with respect to FIG. 6.

Figure 2:
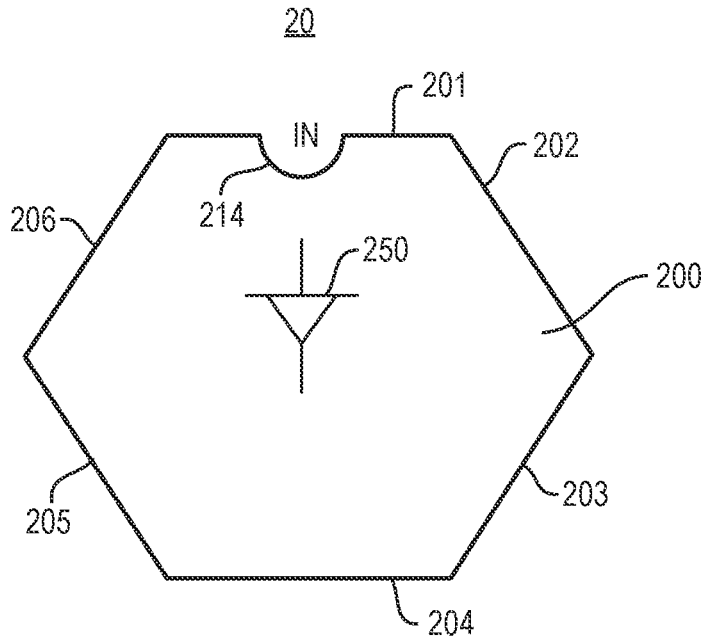
FIG. 2 shows a top plan view of an LED micro-module cell 20, according to a representative embodiment.

FIG. 2 shows a top plan view of an LED micro-module cell 20, according to a representative embodiment. LED micro-module cell (third micro-module cell) 20 includes a housing 200 that is generally hexagonally shaped with a top surface, a bottom surface (not shown) and six exterior sidewalls 201, 202, 203, 204, 205 and 206. A second solid-state lighting source 250, which may be at least one light emitting diode (LED) or a string of LEDs, is disposed to emit light from the top surface of housing 200. Sidewall 201 is configured to include an input (IN) terminal 214. Terminal 214 is a concave terminal formed within sidewall 201 of housing 200, and is configured to have corresponding shape and dimension to insertably receive and hold a protruding terminal having corresponding conforming shape and dimension (such as protruding terminal 610 shown in FIGS. 11A and 11B). In representative embodiments, second solid-state lighting source 250 may emit light of a different color than solid-state lighting source 150 of basic micro-module cell 10 shown in FIG. 1, or second solid-state lighting source 250 may emit white light in contrast to colored light emitted by solid-state lighting source 150 of basic micro-module cell 10.

Figure 3:
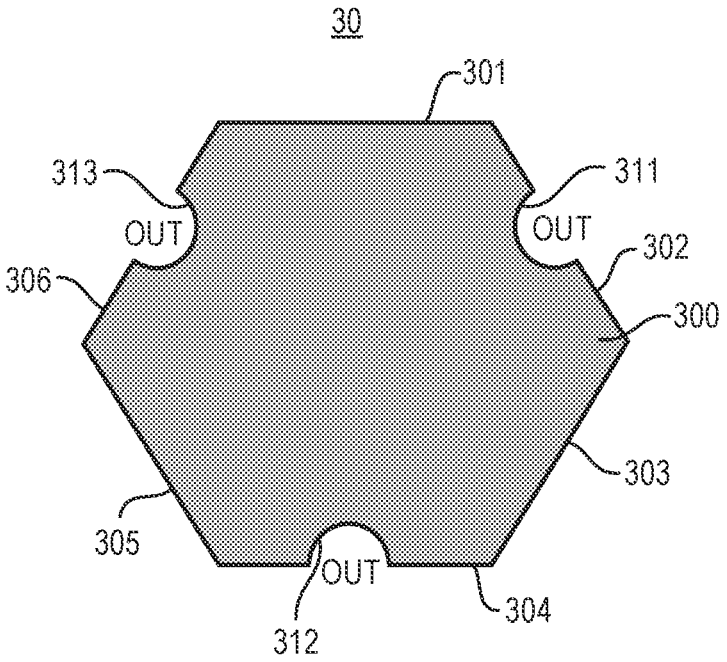
FIG. 3 shows a top plan view of a high power input micro-module cell 30, according to a representative embodiment.

FIG. 3 shows a top plan view of a high power input micro-module cell 30, according to a representative embodiment. High power input micro-module cell (first micro-module cell) 30 includes a housing 300 that is generally hexagonally shaped with a top surface, a bottom surface (not shown) and six exterior sidewalls 301, 302, 303, 304, 305 and 306. Sidewalls 302, 304 and 306 are configured to respectively include output (OUT) terminals 311, 312 and 313. Each of terminals 311, 312 and 313 are concave terminals formed within the sidewalls of housing 300, and are configured to have corresponding shape and dimension to insertably receive and hold a protruding terminal having corresponding conforming shape and dimension (such as protruding terminal 610 shown in FIGS. 11A and 11B). High power input micro-module cell 30 is further configured to include within housing 300 gate control logic such as a control circuit for example, a high power input rectifier bridge and power factor correction (PFC) circuitry, to supply power for a lighting system, as will be subsequently described with respect to FIG. 8. High power input micro-module cell 30 may be used for high power applications requiring greater than about 10 watts of supplied power, for example recessed (down) lighting module applications. In a representative embodiment, high power input micro-module cell 30 may include a DC battery instead of a high power input rectifier bridge, as will also be subsequently described.

Figure 4:
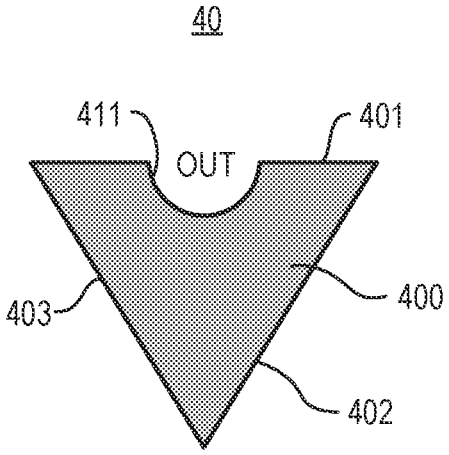
FIG. 4 shows a top plan view of a low power input micro-module cell 40, according to a representative embodiment.

FIG. 4 shows a top plan view of a low power input micro-module cell 40, according to a representative embodiment. Low power input micro-module cell (first micro-module cell) 40 includes a housing 400 that is generally triangularly shaped with a top surface, a bottom surface (not shown) and three exterior sidewalls 401, 402 and 403. Sidewall 401 is configured to include an output (OUT) terminal 411. Terminals 411 is a concave terminal formed within sidewall 401 of housing 400, and is configured to have corresponding shape and dimension to insertably receive and hold a protruding terminal having corresponding conforming shape and dimension (such as protruding terminal 610 shown in FIGS. 11A and 11B). Low power input micro-module cell 40 is further configured to include within housing 400 a low power input rectifier bridge, to supply power for a lighting system, as will be subsequently described with respect to FIG. 9. Low power input micro-module cell 40 may be used for low power applications requiring less than about 10 watts of supplied power, for example night light. It is to be understood that high power micro-module cells 30 and low power micro-module cells 40 may both generally be characterized as power micro-module cells.

Figure 5:
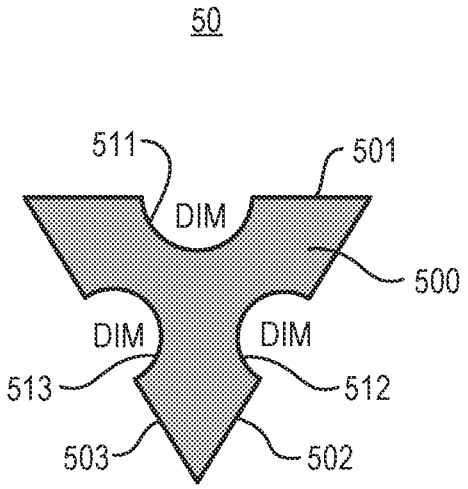
FIG. 5 shows a top plan view of a dimming micro-module cell 50, according to a representative embodiment.

FIG. 5 shows a top plan view of a dimming micro-module cell 50, according to a representative embodiment. Dimming micro-module cell (third micro-module cell) 50 includes a housing 500 that is generally triangularly shaped with a top surface, a bottom surface (not shown) and three exterior sidewalls 501, 502 and 503. Sidewalls 501, 502 and 503 are respectfully configured to include dimming (DIM) terminals 511, 512 and 513. Each of terminals 511, 512 and 513 are concave terminals formed within the sidewalls of housing 500, and are configured to have corresponding shape and dimension to insertably receive and hold a protruding terminal having corresponding conforming shape and dimension (such as protruding terminal 610 shown in FIGS. 11A and 11B). Dimming micro-module cell 50 is further configured to include within housing 500 a plurality of resistors configured to set solid-state lighting source 150 of basic micro-module cell 10 for example, to emit light at a plurality of dimming levels, as will be subsequently described with respect to FIG. 10.

Housings 100, 200, 300, 400 and 500 of basic micro-module cell 10, LED micro-module cell 20, high power input micro-module cell 30, low power input micro-module cell 40 and dimming micro-module cell 50 may be plastic or partial plastic and partial steel with proper electrical insulation. Housings 100, 200 and 300 of basic micro-module cell 10, LED micro-module cell 20, and high power input micro-module cell 30 are each described as generally hexagonally shaped with six exterior sidewalls. The diameter across the top surface of the hexagonally shaped housing between opposing sidewalls may be about 20 mm, and the length of a sidewall in the horizontal direction may be about 10 mm. Housings 400 and 500 of low power input micro-module cell 40 and dimming micro-module cell 50 are each described as generally triangularly shaped with three exterior sidewalls. Housings 100, 200, 300, 400 and 500 thus have complementary geometric shapes that enable interconnection of basic micro-module cell 10, LED micro-module cell 20, high power input micro-module cell 30, low power input micro-module cell 40 and dimming micro-module cell 50 in a variety of configurations or patterns. Housings 100, 200, 300, 400 and 500 may however have any number of a plurality of exterior sidewalls, and thus different geometric shape. In representative embodiments where basic micro-module cells, LED micro-module cells and high power input micro-module cells having additional functionality or complexity are desirable, housings 100, 200 and 300 may have octagonal shape with eight exterior sidewalls and eight respective concave terminals for example. Also, housings 400 and 500 of low power input micro-module cell 40 and dimming micro-module cell 50 may have different general shape including additional exterior sidewalls and concave terminals.

Figure 6:
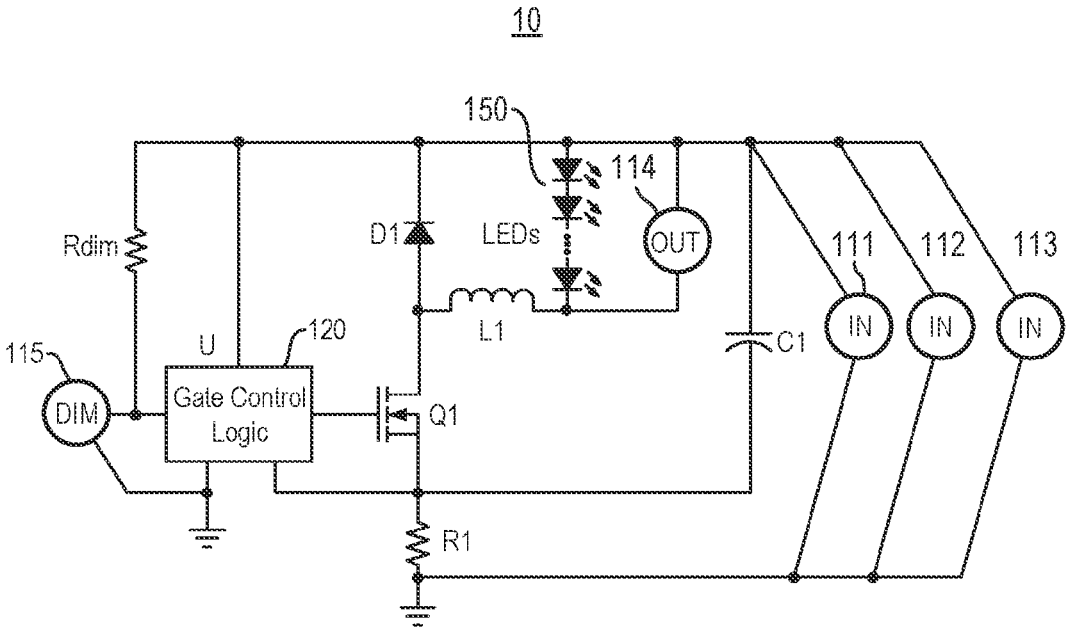
FIG. 6 shows a circuit diagram of basic micro-module cell 10, according to a representative embodiment.

FIG. 6 shows a circuit diagram of basic micro-module cell 10, according to a representative embodiment. Respective IN terminals 111, 112 and 113, OUT terminal 114 and DIM terminal 115 are concave terminals within respective exterior sidewalls 102, 104, 106, 101 and 103 of housing 100 shown in FIG. 1, and are schematically shown in FIG. 6 as corresponding circles. Each of terminals 111, 112, 113, 114 and 115 are schematically shown in the circuit diagram of FIG. 6 as having respective pairs of first and second leads connected thereto. Although not shown in FIG. 1, the respective pairs of first and second leads of terminals 111, 112, 113, 114 and 115 are exposed at different areas of the surface of the corresponding concave terminals within the respective exterior sidewalls. The respective pairs of first and second leads of terminals 111, 112, 113, 114 and 115 are thus electrically connectable to corresponding different sections of a protruding terminal (such as portions 612 and 616 of protruding terminal 610 shown in FIGS. 11A and 11B), when the protruding terminal is inserted into the corresponding concave terminal.

IN terminals 111, 112 and 113 in FIG. 6 are each respectively connectable to either high power input micro-module cell 30 or low power input micro-module cell 40. IN terminals 111, 112 and 113 are each configured to include a first lead and a second lead electrically connected respectively to a positive potential and a ground potential of the power supply provided from either of high power input micro-module cell 30 or low power input micro-module cell 40. IN terminals 111, 112 and 113 are thus connected to each other in parallel. DIM terminal 115 is configured to include a first lead connected to gate control logic (control circuit) 120, and a second lead connected to the ground potential (the second lead of IN terminals 111, 112 and 113). Resistor Rdim is configured to include a first end terminal connected to the first lead of DIM terminal 115, and a second end terminal connected to the positive potential (the first lead of IN terminals 111, 112 and 113). Diode D1 is configured to include a cathode terminal connected to the first lead of IN terminal 111, and an anode terminal. Switch Q1, which in a representative embodiment may be a MOSFET, is configured to include a source terminal connected to the anode terminal of diode D1, a switching terminal connected to gate control logic 120, and a drain terminal. Resistor R1 is configured to include a first end terminal connected to the drain terminal of switch Q1, and a second end terminal connected to the ground potential. Resistor R1 is configured as a sensing resistor that protects switch Q1 from high current stress. Gate control logic 120 is further configured to be connected to the positive potential and the ground potential at the first and second leads of IN terminal 111 respectively, and to the first end terminal of resistor R1. Inductor L1 is configured to include a first end terminal connected to the source terminal of switch Q1, and a second end terminal. Solid-state lighting source 150 is configured to include at least one light emitting diode (LED) or a string of LEDs connected to each other in series, with an anode terminal of the first LED of the string connected to the first lead of IN terminal 111, and a cathode terminal of the last LED of the string connected to the second end terminal of inductor L1. OUT terminal 114 is configured to include a first lead connected to the anode terminal of the first LED of the string of solid-state lighting source 150, and a second lead connected to the cathode terminal of the last LED of the string. Capacitor C1 is configured to include a first terminal connected to the first end terminal of resistor R1 and a second end terminal to the first lead of IN terminal 111.

Diode D1, switch Q1, resistor R1, inductor L1 and capacitor C1 as connected together are configured as a DC to DC buck converter that converts the DC voltage of the supply power provided from high power input micro-module cell 30 or low power input micro-module cell 40 via any of IN terminals 111, 112 and 113 to a suitable DC driving current for solid-state lighting source 150, responsive to a switching signal output from gate control logic 120 to the switching terminal of switch Q1. OUT terminal 114 is connected in parallel to solid-state lighting source 150 and is thus configured to output the DC driving current via its first and second leads. In a representative embodiment, LED micro-module cell 20 may be detachably connectable to basic micro-module cell 10 at OUT terminal 114 using either connector cell 60A or 60B respectively shown in FIGS. 11A and 11B. Second solid-state lighting source 250 of LED micro-module cell 20 may thus be configured to emit light responsive to the DC driving current when LED micro-module cell 20 is connected to OUT terminal 114. In a further representative embodiment, DIM terminal 115 may be detachably connectable to dimming micro-module cell 50, and control logic 120 may be configured to control solid-state lighting source 150 to emit light at a plurality of dimming levels set by dimming micro-module cell 50, as will be described with respect to FIG. 10.

Figure 7:
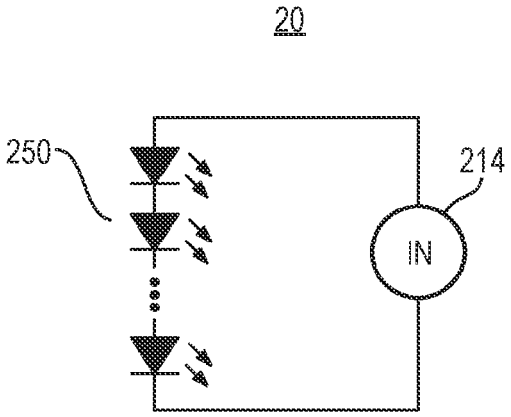
FIG. 7 shows a circuit diagram of LED micro-module cell 20, according to a representative embodiment.

FIG. 7 shows a circuit diagram of LED micro-module cell 20, according to a representative embodiment. IN terminal 214 is a concave terminal within respective exterior sidewall 201 of housing 200 shown in FIG. 2, and is schematically shown in FIG. 7 as a corresponding circle. IN terminal 214 is schematically shown in the circuit diagram of FIG. 7 as having a pair of first and second leads connected thereto. Second solid-state lighting source 250 is configured to include at least one light emitting diode (LED) or a string of LEDs connected to each other in series, with an anode terminal of the first LED of the string connected to the first lead of IN terminal 214, and a cathode terminal of the last LED of the string connected to the second lead of IN terminal 214. Similarly as described above, although not shown in FIG. 2, the first and second leads of terminal 214 are exposed at different areas of the surface of the corresponding concave terminal within exterior sidewall 201. The first and second leads of terminal 214 are thus electrically connectable to corresponding different sections of a protruding terminal (such as portions 612 and 616 of protruding terminal 610 shown in FIGS. 11A and 11B), when the protruding terminal is inserted into concave terminal 214. In a representative embodiment where LED micro-module cell 20 may be detachably connectable to basic micro-module cell 10 at OUT terminal 114 using either connector cell 60A or 60B respectively shown in FIGS. 11A and 11B as described previously, the first and second leads of IN terminal 214 may be electrically connected to the first and second leads of OUT terminal 114 by the corresponding connector cell 60A or 60B. Second solid-state lighting source 250 of LED micro-module cell 20 may thus be configured to emit light responsive to the DC driving current provided from basic micro-module cell 10 via OUT terminal 114.

Figure 8:
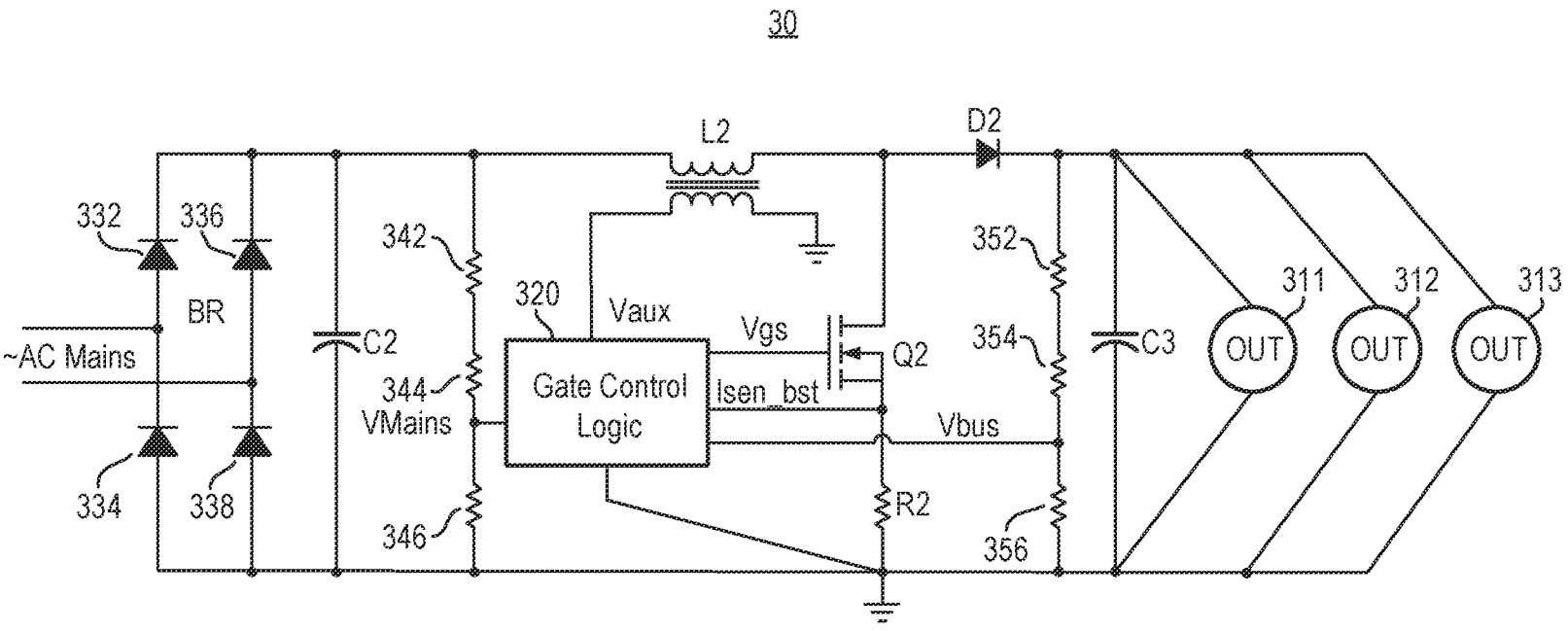
FIG. 8 shows a circuit diagram of high power input micro-module cell 30, according to a representative embodiment.

FIG. 8 shows a circuit diagram of high power input micro-module cell 30, according to a representative embodiment. Respective OUT terminals 311, 312 and 313 are concave terminals within respective exterior sidewalls 302, 304 and 306 of housing 300 shown in FIG. 3, and are schematically shown in FIG. 8 as corresponding circles. Each of terminals 311, 312 and 313 are schematically shown in the circuit diagram of FIG. 8 as having respective pairs of first and second leads connected thereto. Similarly as described above, although not shown in FIG. 8, the respective pairs of first and second leads of terminals 311, 312 and 313 are exposed at different areas of the surface of the corresponding concave terminals within the respective exterior sidewalls. The respective pairs of first and second leads of terminals 311, 312 and 313 are thus electrically connectable to corresponding different sections of a protruding terminal (such as portions 612 and 616 of protruding terminal 610 shown in FIGS. 11A and 11B), when the protruding terminal is inserted into the corresponding concave terminal. In a representative embodiment where basic micro-module cell 10 may be detachably connectable to high power input micro-module cell 30, the first and second leads of any one of IN terminals 111, 112 and 113 of basic micro-module cell 10 may be electrically connected to the first and second leads of any one of OUT terminals 311, 312 and 313 of high power input micro-module cell 30 using either connector cell 60A or 60B respectively shown in FIGS. 11A and 11B. Basic micro-module cell 10 may thus receive power supply from high power input micro-module cell 30.

High power input micro-module cell 30 as shown in FIG. 8 includes diodes 332, 334, 336 and 338 configured as a high power input rectifier bridge BR connected to the AC mains voltage (or DC plant). Diode 332 is configured to include an anode terminal connected to a positive line of the AC mains voltage, and a cathode terminal. Diode 336 is configured to include an anode terminal connected to a negative line of the AC mains voltage, and a cathode terminal. The cathode terminals of diodes 332 and 336 are connected to a start terminal of the primary winding of inductor L2. Diode 334 is configured to include a cathode terminal connected to the positive line of the AC mains voltage, and an anode terminal. Diode 338 is configured to include a cathode terminal connected to the negative line of the AC mains voltage, and an anode terminal. The anode terminals of diodes 334 and 338 are connected at a ground potential node of the high power input micro-module cell 30. Capacitor C2 is configured to include a first terminal connected to the start terminal of the first winding of inductor L2, and a second terminal connected to the ground potential node. Resistors 342, 344 and 346 are configured as a resistive divider. Resistor 342 is configured to include a first end terminal connected to the start terminal of the first winding of inductor L2, and a second end terminal. Resistor 344 is configured to include a first end terminal connected to the second end terminal of resistor 342, and a second end terminal. Resistor 346 is configured to include a first end terminal connected to the second end terminal of resistor 344, and a second end terminal connected to the ground potential node. A Vmains signal proportional to the rectified waveform is provided from the node between resistors 344 and 346 to gate control logic (control circuit) 320. The Vmains signal is indicative of the nominal voltage of the AC mains voltage, i.e., 120 volts AC, 277 volts AC or _230 volts AC, or a DC voltage in the case that high power input micro-module cell 30 is connected to a DC plant. Diode D2 is configured to include an anode terminal connected to the finish terminal of the primary winding of inductor L2, and a cathode terminal connected to the first leads of OUT terminals 311, 312 and 313.

As further shown in FIG. 8, switch Q2, which in a representative embodiment may be a MOSFET, is configured to include a source terminal connected to the finish terminal of the primary winding of inductor L2, a switching terminal connected to gate control logic 320 to receive switching signal Vgs, and a drain terminal. Resistor R2 is configured to include a first end terminal connected to the drain terminal of switch Q2, and a second end terminal connected to the ground potential node. A current feedback signal Isen_bst is provided from the drain of switch Q2 to gate control logic 320. Capacitor C3 in configured to include a first terminal connected to the cathode terminal of diode D2 and the first leads of OUT terminals 311, 312 and 313, and a second terminal connected to the ground potential node and the second leads of OUT terminals 311, 312 and 313. A DC bus voltage is provided across capacitor C3 to OUT terminals 311, 312 and 313. Resistors 352, 354 and 356 are configured as a resistive divider. Resistor 352 is configured to include a first end terminal connected to the cathode terminal of diode D2, and a second end terminal. Resistor 354 is configured to include a first end terminal connected to the second end terminal of resistor 352, and a second end terminal. Resistor 356 is configured to include a first end terminal connected to the second end terminal of resistor 354, and a second end terminal connected to the ground potential node. A Vbus signal is provided as a feedback signal proportional to DC bus voltage from the node between resistors 354 and 356 to gate control logic (control circuit) 320. Also, a reflected voltage Vaux signal from a finish terminal of the secondary winding of inductor L2 is provided to gate control logic 320, and the start terminal of the secondary winding of inductor L2 is connected to the ground potential node.

Capacitor C2, inductor L2, switch Q2, diode D2, resistor R2 and capacitor C3 as connected together are configured as a power factor correction (PFC) circuit that functions to achieve good power factor and total harmonic distortion (THD). Gate control logic 320 stabilizes the DC bus voltage across capacitor C3 responsive to Vaux, Vbus, Isen-Bst and Vmains signals. Gate control logic 320 is configured to control the current through inductor L2 responsive to the Vmains signal. Also, as soon as the reflected voltage Vaux signal from inductor L2 goes to zero, gate control logic 320 controls switching signal Vgs to turn switch Q2 on, to achieve critical conduction mode switching for high efficiency. Responsive to the Isen_bst signal, gate control logic 320 further controls the current through switch Q2 to be a sine wave in phase with the AC mains voltage. This also helps protect switch Q2 from high current stress. In representative embodiments, a DC battery cell or a DC plant such as a back-up power source may be used for non-AC applications. The DC battery cell may be connected directly to OUT terminals 311, 312 and 313, bypassing the high power input rectifier bridge BR and the power factor correction (PFC) circuit. The DC plant on the other hand may be connected directly to the AC mains without bypassing the high power rectifier bridge BR and the power factor correction (PFC) circuit.

In representative embodiments, gate control logic 120 and gate control logic 320 respectively shown in FIGS. 6 and 8 may respectively be a microprocessor or microcontroller, and may include memory and/or be connected to memory. The functionality of gate control logic 120 and 320 may be implemented by one or more processors or controllers. In either case, gate control logic 120 and 320 may be programmed using software or firmware (e.g., stored in memory) to perform the corresponding functions described, or may be implemented as a combination of dedicated hardware to perform some functions and a processor (e.g., one or more programmed microprocessors and associated circuitry) to perform other functions. Examples of controller components that may be employed in various representative embodiments include, but are not limited to, conventional microprocessors, microcontrollers, application specific integrated circuits (ASICs) and field programmable gate arrays (FPGAs).

Figure 9:
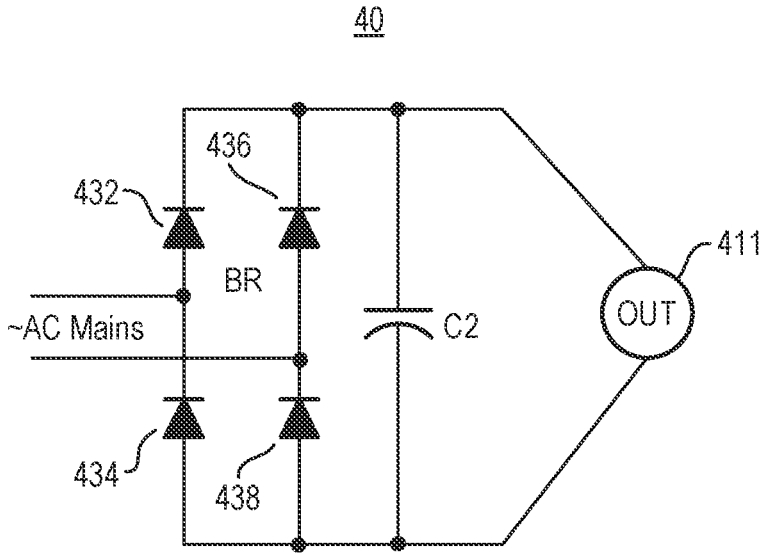
FIG. 9 shows a circuit diagram of low power input micro-module cell 40, according to a representative embodiment.

FIG. 9 shows a circuit diagram of low power input micro-module cell 40, according to a representative embodiment. OUT terminal 411 is a concave terminal within exterior sidewall 401 of housing 400 shown in FIG. 4, and is schematically shown in FIG. 9 as a corresponding circle. OUT terminal 411 is schematically shown in the circuit diagram of FIG. 9 as having a respective pair of first and second leads connected thereto. Similarly as described above, although not shown in FIG. 9, the pair of first and second leads of terminal 411 is exposed at different areas of the surface of the corresponding concave terminal within exterior sidewall 401. The pair of first and second leads of terminal 411 is thus electrically connectable to corresponding different sections of a protruding terminal (such as portions 612 and 616 of protruding terminal 610 shown in FIGS. 11A and 11B), when the protruding terminal is inserted into the corresponding concave terminal. In a representative embodiment where basic micro-module cell 10 may be detachably connectable to low power input micro-module cell 40, the first and second leads of any one of IN terminals 111, 112 and 113 of basic micro-module cell 10 may be electrically connected to the first and second leads of OUT terminal 411 of low power input micro-module cell 40 using either connector cell 60A or 60B respectively shown in FIGS. 11A and 11B. Basic micro-module cell 10 may thus receive power supply from low power input micro-module cell 40.

Low power input micro-module cell 40 as shown in FIG. 9 includes diodes 432, 434, 436 and 438 configured as a low power input rectifier bridge BR connected to the AC mains voltage. Diode 432 is configured to include an anode terminal connected to a positive line of the AC mains voltage, and a cathode terminal. Diode 436 is configured to include an anode terminal connected to a negative line of the AC mains voltage, and a cathode terminal. The cathode terminals of diodes 432 and 436 are connected to a first end terminal of capacitor C4 and a first lead of OUT terminal 411. Diode 434 is configured to include a cathode terminal connected to the positive line of the AC mains voltage, and an anode terminal. Diode 438 is configured to include a cathode terminal connected to the negative line of the AC mains voltage, and an anode terminal. The anode terminals of diodes 434 and 438 are connected to a second end terminal of capacitor C4 and a second lead of OUT terminal 411. Low power input micro-module cell 40 is used for low power applications of less than about 10 watts, which do not need power factor correction. In a representative embodiment, a DC battery cell may be used for a non-AC application, and may be connected directly to OUT terminal 411, bypassing the low power input rectifier bridge BR.

Figure 10:
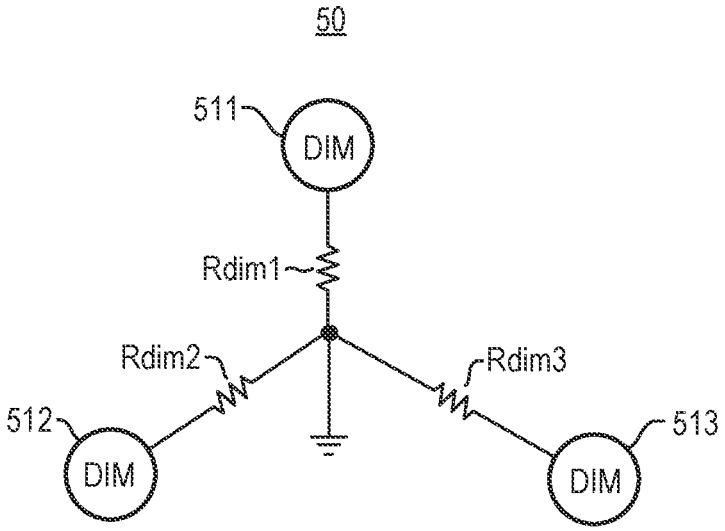
FIG. 10 shows a circuit diagram of dimming micro-module cell 50, according to a representative embodiment.

FIG. 10 shows a circuit diagram of dimming micro-module cell 50, according to a representative embodiment. Respective DIM terminals 511, 512 and 513 are concave terminals within respective exterior sidewalls 501, 502 and 503 of housing 500 shown in FIG. 5, and are schematically shown in FIG. 10 as corresponding circles. Each of terminals 511, 512 and 513 are schematically shown in the circuit diagram of FIG. 10 as having respective pairs of first and second leads connected thereto. Similarly as described above, although not shown in FIG. 10, the respective pairs of first and second leads of terminals 511, 512 and 513 are exposed at different areas of the surface of the corresponding concave terminals within the respective exterior sidewalls. The respective pairs of first and second leads of terminals 511, 512 and 513 are thus electrically connectable to corresponding different sections of a protruding terminal (such as portions 612 and 616 of protruding terminal 610 shown in FIGS. 11A and 11B), when the protruding terminal is inserted into the corresponding concave terminal. In a representative embodiment where dimming micro-module cell 50 may be detachably connectable to basic micro-module cell 10, the first and second leads of DIM terminal 115 of basic micro-module cell 10 may be electrically connected to the first and second leads of any one of DIM terminals 511, 512 and 513 of dimming micro-module cell 50 using either connector cell 60A or 60B respectively shown in FIGS. 11A and 11B. Dimming micro-module cell 50 may thus set solid-state lighting source 150 of basic micro-module cell 10 to emit light at a plurality of dimming levels, depending on which particular one of DIM terminals 511, 512 and 513 is electrically connected to DIM terminal 115 of basic micro-module cell 10.

In FIG. 10, for the sake of simplicity, only the respective first leads of DIM terminals 511, 512 and 513 are schematically shown. Resistor Rdim1 is configured to include a first end terminal connected to the shown first lead of DIM terminal 511, and a second end terminal connected to the ground potential node as shown. Resistor Rdim2 is configured to include a first end terminal connected to the shown first lead of DIM terminal 512, and a second end terminal connected to the ground potential node as shown. Resistor Rdim3 is configured to include a first end terminal connected to the shown first lead of DIM terminal 513, and a second end terminal connected to the ground potential node as shown. The second respective leads (not shown) of DIM terminals 511, 512 and 513 are each connected to the shown ground potential node. The position of dimming micro-module cell 50 is adjustable with respect to basic micro-module cell 10, so that respective ones of the first end terminals of resistors Rdim1, Rdim2 and Rdim3 may be interconnected with resistor Rdim of basic micro-module cell 10 as part of a resistive divider, to set the dimming level of solid-state lighting source 150 under control of gate control logic 120. In a representative embodiment, resistors Rdim1, Rdim2 and Rdim3 may have different resistance values, to set solid-state lighting source 150 of basic micro-module cell 10 to emit light at respective dimming levels of 10%, 20% and 50% for example, depending on which particular one of DIM terminals 511, 512 and 513 is electrically connected to DIM terminal 115 of basic micro-module cell 10. In other representative embodiments, the resistance values of any of a variety of resistance values Rdim1, Rdim2 and Rdim3 may be different to set respective dimming levels other than 10%, 20% and 50% as described above.

Figure 11B:
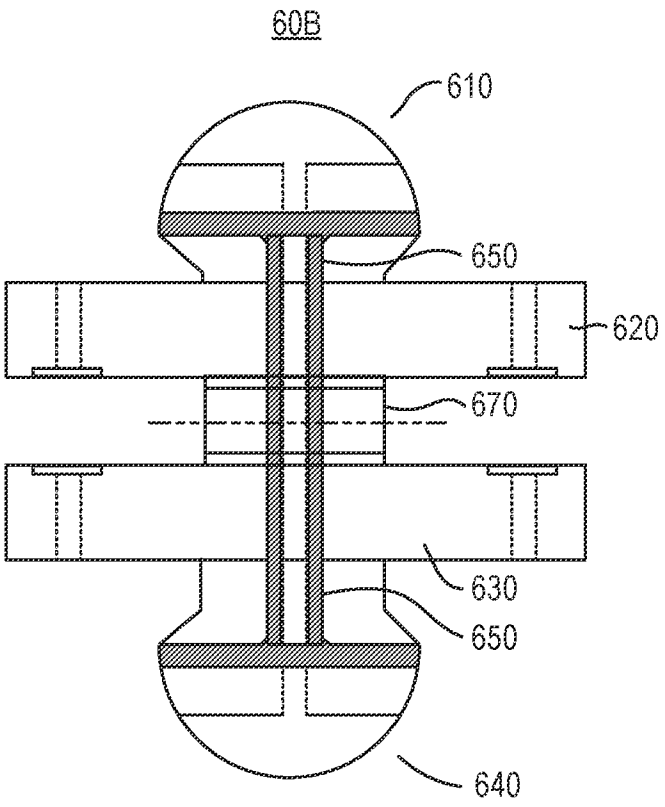
FIG. 11B shows a side view of a connector cell 60B, according to a representative embodiment.
Figure 11A:
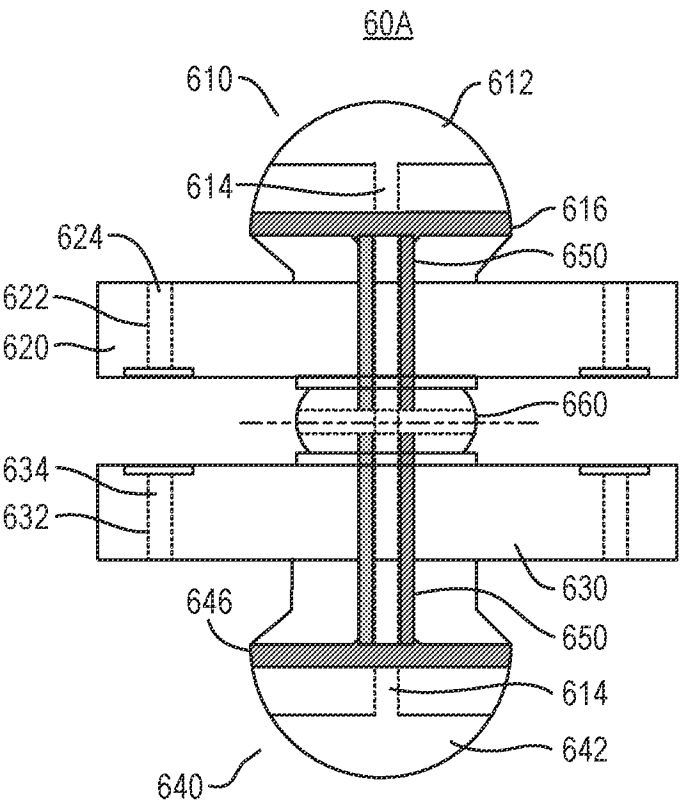
FIG. 11A shows a side view of a connector cell 60A, according to a representative embodiment.

FIG. 11A shows a side view of a connector cell 60A, according to a representative embodiment. Connector cell (first and/or second connector cell) 60A is configured to detachably connect any of LED micro-module cell 20, high power input micro-module cell 30, low power input micro-module cell 40 and dimming micro-module cell 50 to basic micro-module cell 10, and/or to detachably connect basic micro-module cells 10 to each other, in various circuit configurations.

Connector cell 60A as shown in FIG. 11A includes a first base plate 620 made of plastic, rubber, or other insulative material, configured to include a pair of mounting holes 622 formed there through. Protruding terminal 610 is integrally disposed to extend from the upper surface of first base plate 620, and is configured generally of plastic or the like to include a conductive first portion or cap 612 covering a distal end, and a conductive second portion or ring 616 covering and around an upward edge of a neck portion of protruding terminal 610. Conductive first and second portions 612 and 616 may be copper or silver. Connector cell 60A further includes a second base plate 630 also made of plastic, rubber, or other insulative material, configured to include a pair of mounting holes 632 formed there through. Protruding terminal 640 is integrally disposed to extend from the lower surface of second base plate 630, and is also configured generally of plastic or the like to include a conductive first portion or cap 642 covering a distal end, and a conductive second portion or ring 646 covering and around a downward edge of a neck portion of protruding terminal 640. Conductive first and second portions 642 and 646 may be copper or silver. The bottom surface of first base plate 620 and the top surface of second base plate 630 as shown in FIG. 11A are connected to each other by plastic ball bearing (pivoting member) 660. As shown in FIG. 11A, a flexible wire 650 extends through first and second base plates 620 and 630, the neck portions of protruding terminals 610 and 640, and ball bearing 660.

Figure 11C:
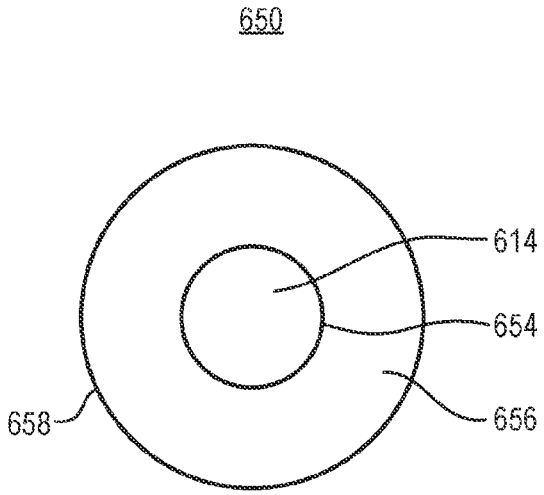
FIG. 11C shows a sectional view of flexible wire 650, according to a representative embodiment.

FIG. 11C shows a sectional view of flexible wire 650, according to a representative embodiment. Flexible wire 650 is configured to include flexible copper wire string 614 as a core covered with a layer of insulation tape 654. As shown in FIG. 11A, flexible wire string has first and second opposite ends that are configured to be respectively connected to conductive first portions or caps 612 and 642. As further shown in FIG. 11C, insulation tape 654 is covered by copper ground wire 656. Insulation tape 658 covers ground wire 656. Ground wire 656 has first and second opposite ends that are configured to be respectively connected to second portions or rings 616 and 646. Protruding terminals 610 and 640 may be removably insertable into the concave terminals of respective first and second micro-module cells, so that conductive first portions or caps 612 and 642 may be electrically connected to the first leads of the concave terminals, and so that conductive second portions or rings 616 and 646 may be electrically connected to the second leads of the corresponding concave terminals. The first and second micro-module cells as here mentioned may be any of basic micro-module cell 10, LED micro-module cell 20, high power input micro-module cell 30, low power input micro-module cell 40 and dimming micro-module cell 50. First plate 620 of connector 60A may be secured or mounted to the exterior sidewall of the corresponding first micro-module cell by screws 624 inserted through mounting holes 622. Second plate 630 may be secured or mounted to the exterior sidewall of the corresponding second micro-module cell by screws 634 inserted through mounting holes 632. Connector cell 60A may thus be configured to detachably connect the first micro-module cell to the second micro-module cell in a pivotable relationship, while maintaining electrical connection between the first and second micro-module cells. Connector call 60A may thus be used to connect the micro-module cells in various three-dimensional configurations.

FIG. 11B shows a side view of a connector cell 60B, according to a representative embodiment. Connector cell 60B is identical to connector cell 60A shown in FIG. 11A, except for including a fixed member 670 instead of plastic ball bearing 660. As shown in FIG. 11B, the bottom surface of first base plate 620 and the top surface of second base plate 630 are connected to each other by fixed member 670. Similarly as described above, a flexible wire 650 extends through first and second base plates 620 and 630, the neck portions of protruding terminals 610 and 640, and fixed member 670. First and second plates 620 and 630 of connector 60B may be secured or mounted to the exterior sidewalls of corresponding first and second micro-module cells similarly as described above. Connector cell 60B may thus be configured to detachably connect the first micro-module cell to the second micro-module cell in a fixed relationship along a lateral direction of micro-module cells, while maintaining electrical connection between the first and second micro-module cells. Connector call 60B may thus be used to connect the micro-module cells in various two-dimensional configurations.

Figure 12:
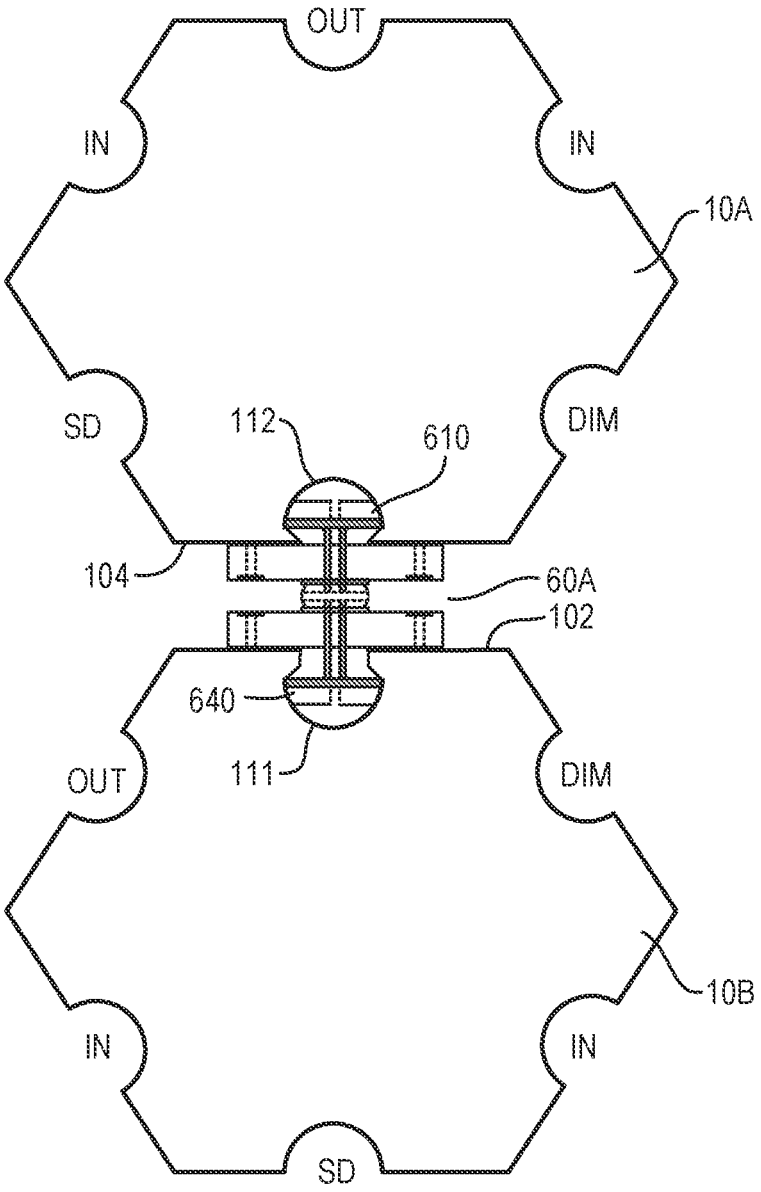
FIG. 12 shows a top plan view of connector cell 60A configured to detachably connect basic micro-module cells 10A and 10B to each other, according to a representative embodiment.

FIG. 12 shows a top plan view of connector cell 60A configured to detachably connect basic micro-module cells 10A and 10B to each other, according to a representative embodiment. As shown, protruding terminal 610 of connector cell 60A is inserted into IN terminal 112 within exterior sidewall 104 of basic micro-module cell 10A, and protruding terminal 640 of connector cell 60A is inserted into IN terminal 111 within exterior sidewall 102 of basic micro-module cell 10B, to electrically connect the first leads of IN terminals 111 and 112 to each other, and to electrically connect the second leads of IN terminals 111 and 112 to each other. In this representative embodiment, the IN terminals 111 and 112 are configured to connect the power supply from basic micro-module cell 10A to basic micro-module cell 10B, or vice-versa. Although not shown in FIG. 12, connector cell 10A detachably connects basic micro-module cell 10A to basic micro-module cell 10B in a pivotable relationship while maintaining electrical connection.

Figure 13:
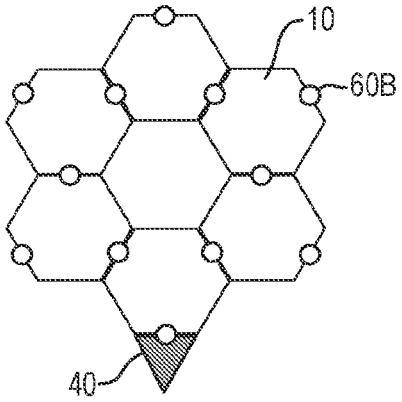
FIG. 13 shows a circuit configuration including low power input micro-module cell 40 providing supply power to a plurality of basic micro-module cells 10, according to a representative embodiment.

FIG. 13 shows a circuit configuration including low power input micro-module cell 40 providing supply power to a plurality of basic micro-module cells 10, according to a representative embodiment. Connector cells 60B are configured to detachably connect low power input micro-module cell 40 and basic micro-module cells 10 to each other in a two-dimensional configuration. Additional basic micro-module cells 10, LED micro-module cells 20 and/or dimming micro-module cells 50 may be detachably connected to the shown basic micro-module cells 10 by the available connector cells 60B. In a variation, one or more of connector cells 60B may be replaced by connector cells 60A to provide a three-dimensional configuration.

Figure 14:
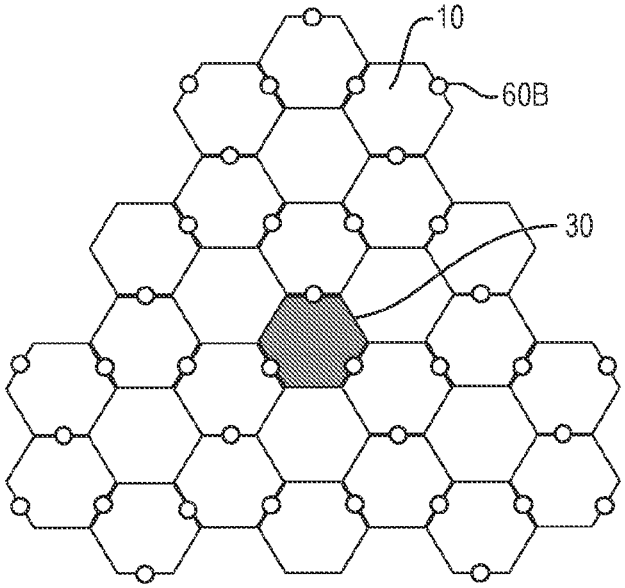
FIG. 14 shows a circuit configuration including high power input micro-module cell 30 providing supply power to a plurality of basic micro-module cells 10, according to a representative embodiment.

FIG. 14 shows a circuit configuration including high power input micro-module cell 30 providing supply power to a plurality of basic micro-module cells 10, according to a representative embodiment. Connector cells 60B are configured to detachably connect high power input micro-module cell 30 and basic micro-module cells 10 to each other in a two-dimensional configuration. Additional basic micro-module cells 10, LED micro-module cells 20 and/or dimming micro-module cells 50 may be detachably connected to the shown basic micro-module cells 10 by the available connector cells 60B. In a variation, one or more of connector cells 60B may be replaced by a connector cell 60A to provide a three-dimensional configuration.

Figure 15:
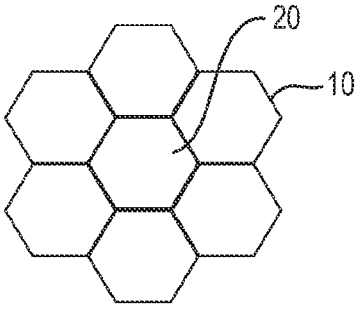
FIG. 15 shows a circuit configuration including LED micro-module cell 20 and a plurality of basic micro-module cells 10, according to a representative embodiment.

FIG. 15 shows a circuit configuration including LED micro-module cell 20 and a plurality of basic micro-module cells 10, according to a representative embodiment. Basic micro-module cells 10 may be detachably connected to each other by connector cells 60A or 60B (not shown) in either a two-dimensional or three-dimensional configuration. LED micro-module cell 20 may be detachably connected to any single one of basic micro-module cells 10 by either of a connector cell 60A or 60B (not shown), to provide a mixed color configuration. Additional basic micro-module cells 10, LED micro-module cells 20 and/or dimming micro-module cells 50 may be detachably connected at any available exterior sidewalls of the shown basic micro-module cells 10 by additional connector cells (not shown). In this representative embodiment, either a high power input micro-module cell 30 or a low power input micro-module cell 40 (not shown) may be detachably connected to any one of basic micro-module cells 10 to provide supply power.

Figure 16:
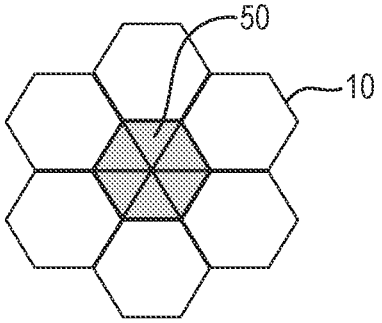
FIG. 16 shows a circuit configuration including a plurality of dimming micro-module cells 50 and basic micro-module cells 10, according to a representative embodiment.

FIG. 16 shows a circuit configuration including a plurality of dimming micro-module cells 50 and basic micro-module cells 10, according to a representative embodiment. Dimming micro-module cells 50 are detachably coupled to respective different single ones of the basic micro-module cells 10 by connector cells 60A or 60B (not shown) in either a two-dimensional or three-dimensional configuration, to provide respective dimming of solid-state lighting sources 150 of the basic micro-module cells 10. Basic micromodules 10 as shown may be detachably connected to each other by connector cells 60A or 60B (not shown). Additional basic micro-module cells 10 and/or LED micro-module cells 20 may be detachably connected at any available exterior sidewalls of the shown basic micro-module cells 10 by additional connector cells (not shown). In this representative embodiment, either a high power input micro-module cell 30 or a low power input micro-module cell 40 (not shown) may be detachably connected to any one of basic micro-module cells 10 to provide supply power.

Figure 17:
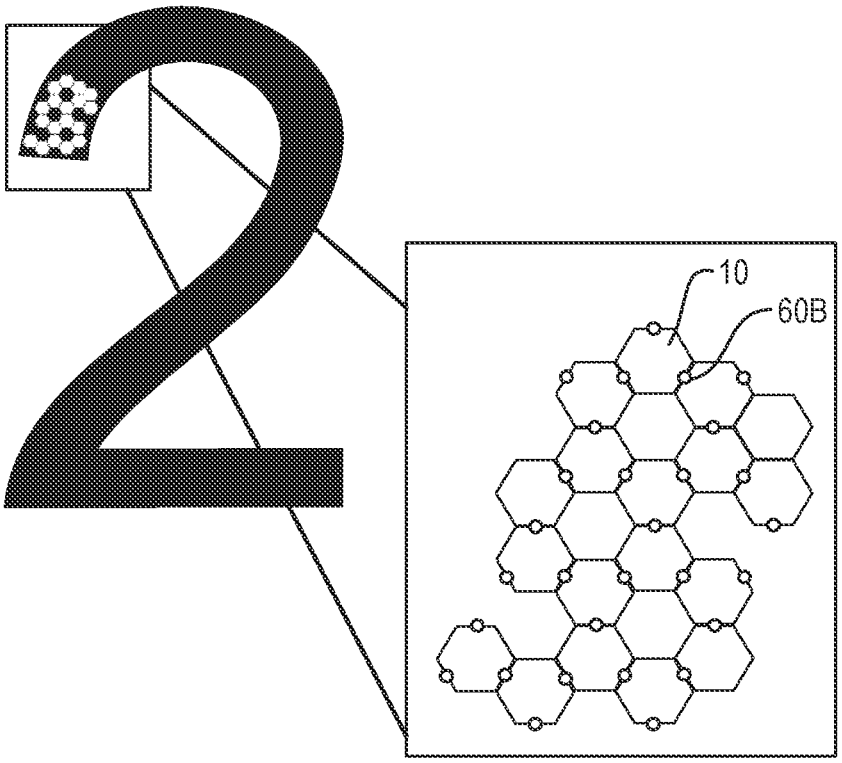
FIG. 17 shows a circuit configuration of a complex display pattern, according to a representative embodiment.

FIG. 17 shows a circuit configuration of a complex display pattern, according to a representative embodiment. A variety of basic micro-module cells 10 may be detachably connected to each other by connector cells 60B, to provide a high resolution display. Additional basic micro-module cells 10, LED micro-module cells 20 and/or dimming micro-module cells 50 may be detachably connected at any available exterior sidewalls of the shown basic micro-module cells 10 by additional connector cells (not shown). In this representative embodiment, a high power input micro-module cell 30 (not shown) may be detachably connected to any one of basic micro-module cells 10 to provide supply power.

Figure 18:
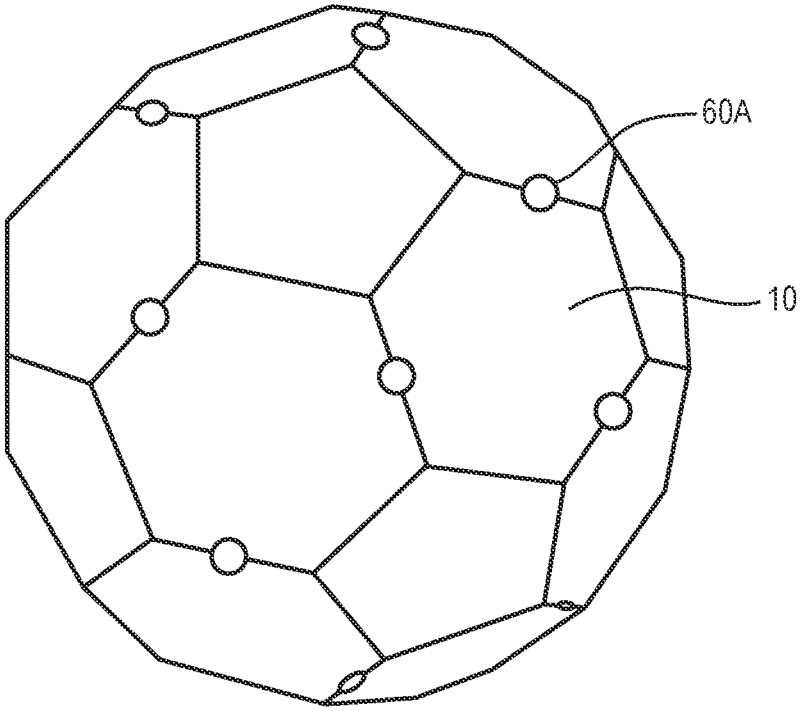
FIG. 18 shows a circuit configuration of a three-dimensional lighting application, according to a representative embodiment.

FIG. 18 shows a circuit configuration of a three-dimensional lighting application, according to a representative embodiment. Basic micro-module cells 10 may be detachably connected to each other in pivotable relationships at different angles by connector cells 60A, to provide a lighting application of desired shape. The shown basic micro-module cells 10 may be replaced by or supplemented with LED micro-module cells 20 and/or dimming micro-module cells 50 to provide mixed color and/or dimming capabilities. In this representative embodiment, either a high power input micro-module cell 30 or a low power input micro-module cell 40 (not shown) may be detachably connected to any one of basic micro-module cells 10 to provide supply power.

In the circuit configurations shown in FIGS. 13-18, it should be understood that one or more of the various micro-module cells including basic micro-module cell 10, LED micro-module cell 20, high power input micro-module cell 30, low power input micro-module cell 40 and dimming micro-module cell 50 of the lighting applications may be fixedly secured or physically mounted to any wall, ceiling, construction beam or exposed surface within the interior or exterior of a building, or to an exterior tower or pole for example. In other representative embodiments, the various micro-module cells may be fixedly secured or physically mounted in place on a motherboard or the like. The circuit configurations shown in FIGS. 13-18 can be utilized as two-dimensional or three-dimensional lighting applications such as for indoor and/or bedroom lighting, decorative lighting, advertisement lighting, lighting system prototyping, and/or educational purposes. The various micro-module cells can be further utilized to enable plug and play operation for personalized lighting system design. The micro-module cells can be easily replaced in designed lighting systems, reducing maintenance time and expense.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited. Also, reference numerals appearing in the claims, if any, are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A lighting system comprising:

a plurality of micro-module cells, each having independent functionality, the micro-module cells comprising a first micro-module cell configured to supply power for the lighting system, and a second micro-module cell including a solid-state lighting source configured to emit light responsive to the supplied power from the first micro-module cell; and a first connector cell configured to detachably connect the second micro-module cell to the first micro-module cell in a pivotable manner, and provide electrical connection between the first and second micro-module cells, the first connector cell comprising a first base plate configured to be detachably connected to the first micro-module cell, a second base plate configured to be detachably connected to the second micro-module cell, and a pivotable member configured to connect the first and second base plates together.

2. The lighting system of claim 1, wherein the second micro-module cell comprises:

a DC to DC buck converter configured to convert the supplied power to a driving current for the solid-state lighting source; and a control circuit configured to control the DC to DC buck converter to adjust the driving current to emit light from the solid-state light source at a plurality of dimming levels.

3. The lighting system of claim 2, wherein the second micro-module cell further comprises an output terminal configured to provide the driving current as an output of the second micro-module cell, the lighting system further comprising:

a third micro-module cell including a second solid-state lighting source configured to emit light responsive to the driving current output from the second micro-module cell; and a second connector cell configured to detachably connect the second micro-module cell to the third micro-module cell, and provide electrical connection between the second and third micro-module cells.

4. The lighting system of claim 3, wherein the solid-state lighting source of the second micro-module cell and the second solid-state lighting source of the third micro-module cell emit light of respectively different color.

5. The lighting system of claim 1, wherein the first and second micro-module cells each comprise a housing having a plurality of exterior sidewalls, one or more of the exterior sidewalls of the housing having a concave terminal, the first connector having a protruding terminal configured to be insertable into the concave terminal for providing electrical connection.

6. The lighting system of claim 5, wherein the second micro-module cell comprises a plurality of concave terminals that are configured to be electrically connected to each other.

7. The lighting system of claim 5, wherein the housing is hexagonally shaped including six exterior sidewalls.

8. The lighting system of claim 5, wherein the solid-state lighting source of the second micro-module cell comprises at least one light emitting diode mounted to emit light from a top surface of the housing.

9. The lighting system of claim 1, further comprising:

a third micro-module cell configured to set the solid-state lighting source of the second micro-module cell to emit light at a plurality of dimming levels; and a second connector cell configured to detachably connect the second micro-module cell to the third micro-module cell, and provide electrical connection between the second and third micro-module cells.

10. The lighting system of claim 9, wherein the third micro-module cell comprises a plurality of resistors each having a respective first end terminal, and a respective second end terminal connected to ground, and wherein a position of the third micro-module cell is adjustable with respect to the second connector cell so that different respective ones of the first end terminals are electrically connected to the second micro-module cell via the second connector cell to set the plurality of dimming levels.

11. The lighting system of claim 1, wherein the first micro-module cell is connectable to AC mains voltage and is configured to supply DC power for the lighting system.

12. The lighting system of claim 11, wherein the first micro-module cell comprises a control circuit that stabilizes the DC power.

13. The lighting system of claim 1, wherein the first micro-module cell comprises a battery configured to supply DC power for the lighting system.

14. The lighting system of claim 1, further comprising at least one additional second micro-module cell, and a plurality of the first connector cells configured to detachably connect the at least one additional second micro-module cell to at least one of the first and second micro-module cells, and provide electrical connection between the second and first micro-module cells.

15. The lighting system of claim 1, further comprising:

at least one additional second micro-module connector cell; and a second connector cell comprising a fixed member configured to connect the at least one additional second micro-module cell to the first micro-module cell in a fixed relationship along a lateral direction of the first micro-module cell while maintaining electrical connection.

16. A lighting system comprising:

a power micro-module cell configured to supply power to the lighting system;

a plurality of basic micro-module cells each comprising at least one light emitting diode for emitting light responsive to a driving current, and an integrated driver configured to output the driving current responsive to the supplied power; and a plurality of connector cells configured to detachably connect the basic micro-module cells to at least one of the power micro-module cell and other ones of the basic micro-module cells, and provide electrical connection between the power micro-module cell and the plurality of basic micro-module cells, wherein the power and basic micro-module cells each comprise a housing having a plurality of exterior sidewalls, one or more of the exterior sidewalls of the housing having a concave terminal, and the connector cells having protruding terminals configured to be insertable into the concave terminal for providing electrical connection, and wherein at least one of the connector cells comprises a first base plate configured to be detachably connected to a first of the power and basic micro-module cells, a second base plate configured to be detachably connected to a second of the power and basic micro-module cells, and a pivotable member configured to connect the first and second base plates to each other.

17. The lighting system of claim 16, further comprising:

at least one dimming micro-module cell detachably connectable to respective ones of the basic micro-module cells by at least one additional connector cell and each configured to set the at least one LED of the respective ones of the basic micro-module cells to emit light at any of a plurality of dimming levels, the respective basic micro-module cells each comprising a control circuit configured to control the integrated driver responsive to the at least one dimming micro-module cell to adjust the driving current to emit light from the at least one LED at the set dimming level.

18. The lighting system of claim 16, further comprising:

at least one LED micro-module cell detachably connectable to respective ones of the basic micro-module cells by at least one additional connector cell and each including at least one second LED configured to emit light responsive to the driving current output by the integrated driver of the respective ones of the basic micro-module cells, wherein the at least one LED of the basic micro-module cell and the at least one second LED of the at least one LED micro-module cell emit light of respective different color.

19. The lighting system of claim 16, wherein at least another one of the connector cells comprises a fixed member configured to connect the basic micro-module cells and the power micro-module cell in a fixed relationship along a lateral direction of the power micro-module cell while maintaining electrical connection.

20. The lighting system of claim 16, wherein the housing is hexagonally shaped including six exterior sidewalls.

21. The lighting system of claim 16, wherein the power micro-module cell is connectable to AC mains voltage and is configured to supply DC power for the lighting system.

22. The lighting system of claim 16, wherein the power micro-module cell comprises a battery configured to supply DC power for the lighting system.

* * * * *